US005330375A

United States Patent [19]

Tsujii et al.

[11] Patent Number: 5,330,375

[45] Date of Patent: Jul. 19, 1994

[54] STEERING SYSTEM FOR MARINE PROPULSION UNIT

[75] Inventors: Eiichiro Tsujii; Akihiro Onoue, both of Hamamatsu, Japan

[73] Assignee: Sanshin Kogyo Kabushiki Kaisha, Hamamatsu, Japan

[21] Appl. No.: 14,650

[22] Filed: Feb. 8, 1993

[30] Foreign Application Priority Data

Feb. 6, 1992 [JP] Japan ..... 4-054110

[51] Int. Cl.[5] ..... B63H 25/02

[52] U.S. Cl. ..... 440/61; 180/163

[58] Field of Search ..... 440/53, 61, 62, 63; 114/144 R, 144 E, 150; 180/132, 136, 137; 91/59, 509, 510; 92/51, 52, 109, 134

[56] References Cited

U.S. PATENT DOCUMENTS 3,631,833 1/1972 Shimanckas .
4,419,084 12/1983 Borst ..... 440/63
4,568,292 2/1986 Hall ..... 440/61
4,595,370 6/1986 Small ..... 440/53
4,710,141 12/1987 Ferguson ..... 440/61
4,744,777 5/1988 Ferguson ..... 440/61
4,892,494 1/1990 Ferguson ..... 440/61

FOREIGN PATENT DOCUMENTS 2144295 2/1990 Japan .

*Primary Examiner*—Jesus D. Sotelo
*Attorney, Agent, or Firm*—Knobbe, Martens, Olson & Bear

[57] ABSTRACT

An improved steering mechanism for a marine outboard drive wherein the steering rod connected to the outboard drive end of the wire actuator steering cable is slidably mounted in a guide tube that is formed integrally with a hydraulic assist cylinder and which are affixed to the transom independently of the tilt pin and forwardly of it. This permits the steering mechanism to be assembled as a unit separately from the outboard drive and attached to the transom separately from it.

14 Claims, 3 Drawing Sheets

STEERING SYSTEM FOR MARINE PROPULSION UNIT

BACKGROUND OF THE INVENTION

This invention relates to a steering system for a marine propulsion unit and more particularly to an improved remote steering operator for a marine outboard drive.

Generally marine outboard drives include a propulsion unit that is mounted for steering movement about a generally vertically extending axis in some form of steering or swivel bracket. The steering or swivel bracket is, itself, mounted for pivotal movement about a horizontally extending trim axis by a clamping bracket or other device that is affixed to the transom of a watercraft. The propulsion unit has affixed to it a steering arm which extends forwardly and frequently across the transom for steering of the propulsion unit.

There are many times when it is desirable to steer the propulsion unit from a position remote from the transom, for example by a forwardly positioned steering wheel. To accomplish this movement, there is normally provided a flexible transmitter that is driven by the steering wheel and which extends rearwardly and is connected to the steering bracket or steering arm for steering of the propulsion unit. With this type of system, the flexible cable is generally connected to a member that is slidably supported in a tubular member which is disposed concentrically and telescoped with the tilt axis of the swivel bracket. Frequently hydraulic power assists are employed which also include a hydraulically operated cylinder and actuating valve mechanism which are interconnected with the cable and the steering arm for hydraulic assist of the steering.

There are a number of disadvantages with the type of construction previously used. In the first instance, when the cable actuated member is positioned concentrically with the tilt axis, this type of construction has a number of problems. Since the support for the cable end also defines the tilt axis, it must be made strong enough to sustain propulsion forces and forces which are encountered when underwater obstacles are struck. Also, the unit is disposed so that it will be in proximity to the transom and hence, must be formed from a corrosion resistant material. Thus, the costs of the cable support become excessive. In addition, since the cable guide forms a portion of the propulsion unit, it is not possible to form a separate subassembly and there are difficulties in ensuring accurate assembly. These disadvantages are further multiplied when a hydraulic assist for the steering is provided.

It is, therefore, a principal object of this invention to provide an improved and simplified steering mechanism for a boat propulsion unit.

It is a further object of this invention to provide a steering mechanism for a boat propulsion unit which can be formed as a separate assembly from the propulsion unit.

It is a further object of this invention to provide an improved power assisted steering mechanism for a marine propulsion unit.

It is a further object of this invention to provide a hydraulic steering mechanism for a marine propulsion unit which can be made as a separate assembly.

SUMMARY OF THE INVENTION

The invention is adapted to be embodied in a steering arrangement for a marine outboard drive that is comprised of a clamping bracket that is adapted to be affixed to a transom of a watercraft. A swivel bracket is pivotally connected to the clamping bracket by tilt pivot means for movement of the swivel bracket about a generally horizontally extending tilt axis. A propulsion device is carried by the swivel bracket for steering movement about a steering axis and a steering arm is affixed to the propulsion device and extends toward the watercraft transom. A steering operator is positioned remotely from the transom for operator control and a control cable is affixed at one end to the steering operator for operation thereby.

In accordance with a first feature of the invention, a guide tube for receiving a member operably connected to the other end of the control cable and for supporting the member for movement along a reciprocal axis is spaced from the tilt axis. The member is operatively connected to the steering arm for effecting steering movement of the propulsion device.

In accordance with another feature of the invention, a hydraulically actuated cylinder that is operated by the movement of the control cable is mounted for movement along a reciprocal axis that is spaced from the tilt axis and which is mounted separately from the swivel bracket and is operatively connected to the steering arm for effecting its steering movement.

DETAILED DESCRIPTION OF THE PREFERRED EMBODIMENT OF THE INVENTION

Figure 1:
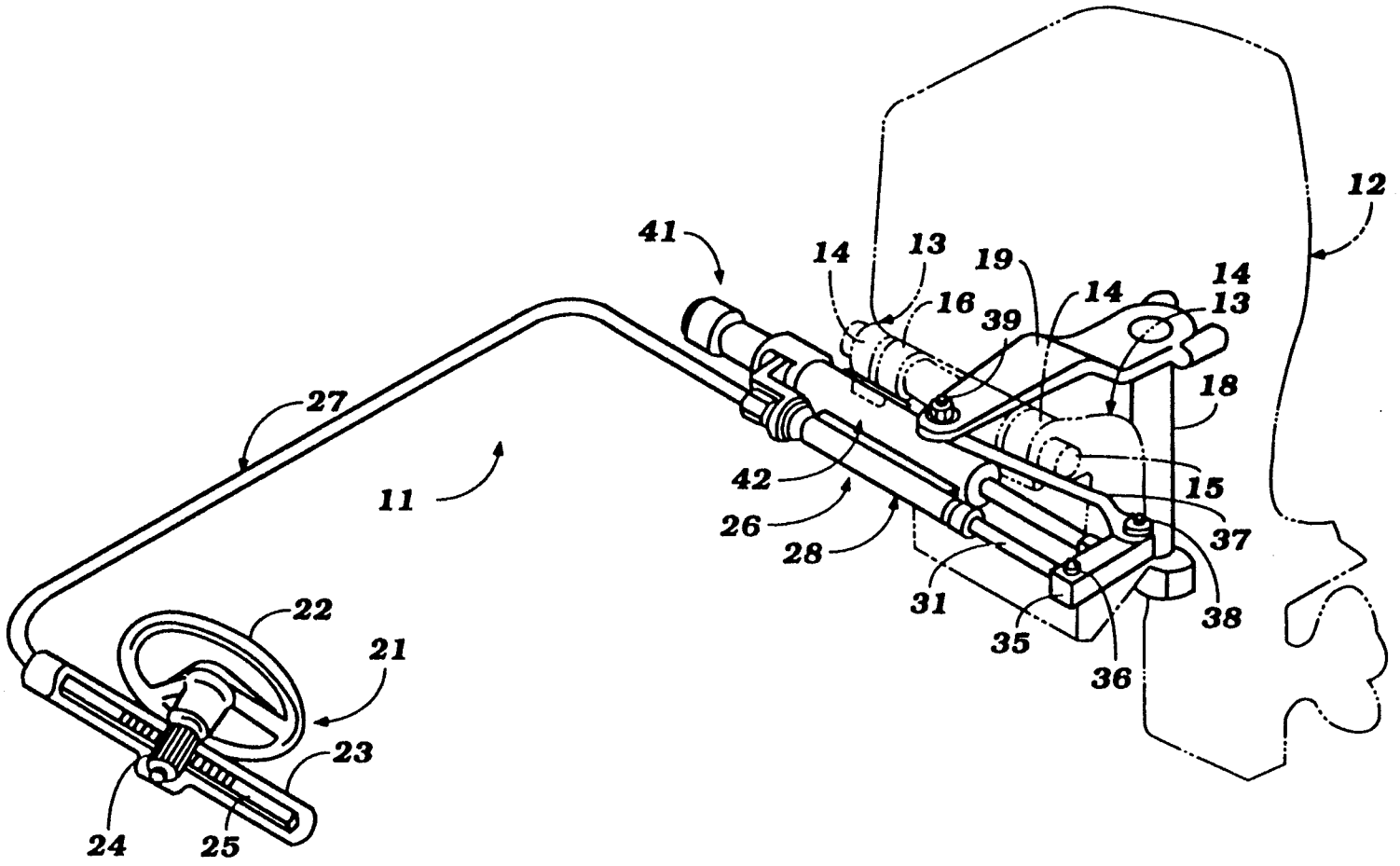
FIG. 1 is a perspective view of a marine propulsion unit steering device constructed in accordance with an embodiment of the invention, with the propulsion device being shown in phantom and a portion of the steering mechanism being broken away.
Figure 2:
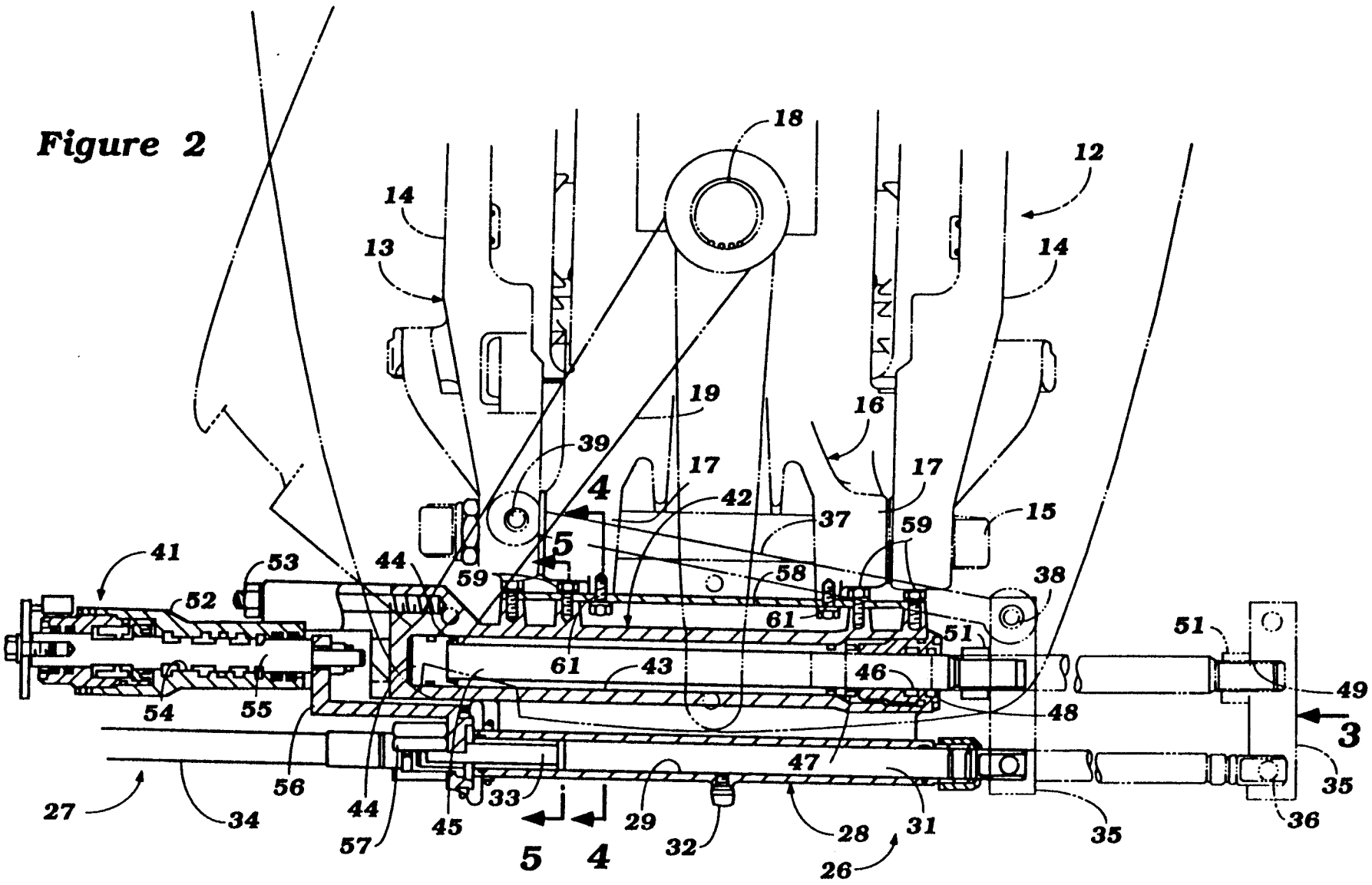
FIG. 2 is an enlarged cross-sectional view taken through the axis of the control cable supporting member and hydraulic piston of the steering mechanism with the marine outboard drive being shown in phantom and illustrated in a straight ahead and fully steered position in one direction.
Figure 3:
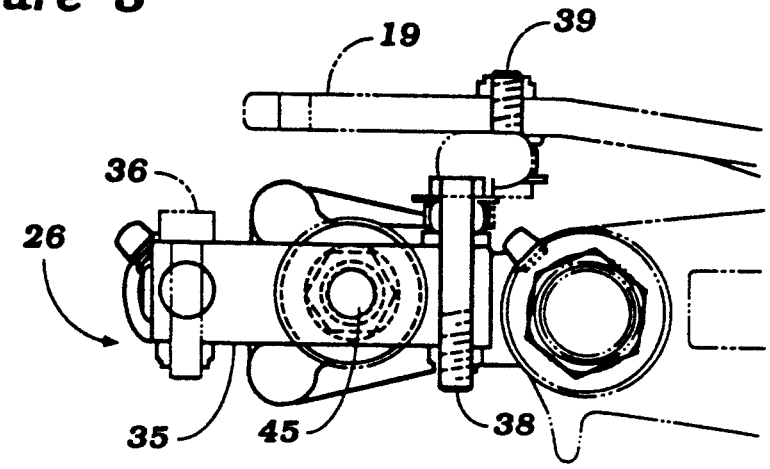
FIG. 3 is an enlarged end elevational view taken in the direction of the arrow 3 in FIG. 2.
Figure 4:
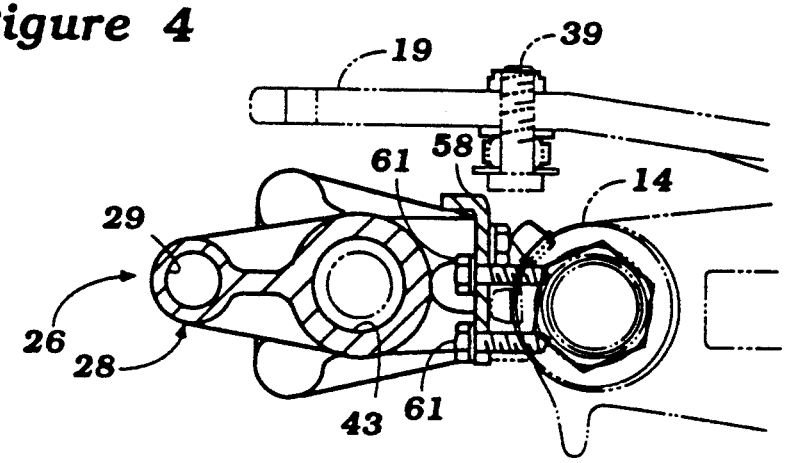
FIG. 4 is an enlarged cross-sectional view taken along the line 4—4 of FIG. 2.
Figure 5:
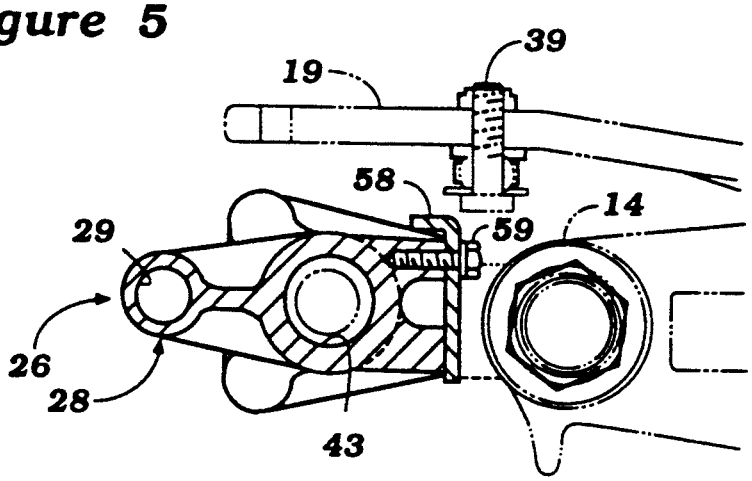
FIG. 5 is an enlarged cross-sectional view taken along the line 5—5 of FIG. 2.

Referring now in detail to the drawings and initially to FIG. 1, a steering device for a marine propulsion unit incorporating the invention is identified generally by the reference numeral 11. In the illustrated embodiment, the steering mechanism 11 is depicted as steering an outboard motor, indicated generally by the reference numeral 12 and shown in phantom. Although the invention is described in conjunction with the steering of an outboard motor, it should be readily apparent that the invention may also be practiced in conjunction with the steering of an outboard drive portion of an inboard/outboard drive and such outboard motors and outboard drives are generically referred to as marine outboard drives. It is to be understood, however, that the invention has particular utility in conjunction with outboard motors since this type of steering mechanism is normally employed with outboard motors.

Although the general construction of the outboard motor is not relevant to the invention, certain components and their relationship is. These components will be described and are comprised of a clamping bracket 13 which has a pair of spaced apart portions 14 and which is affixed in a suitable manner to the transom (not shown) of the associated watercraft. A tilt pivot pin 15 is affixed in trunnion portions of the arms 14. The tilt pivot pin 15 defines a generally horizontally extending tilt axis. The outboard motor 12 is provided with a swivel bracket, indicated generally by the reference numeral 16, which has a pair of spaced apart arm portions 17 that are journaled upon the tilt pivot pin 15.

The swivel bracket 16, in turn, pivotally supports a steering shaft 18 for movement about a generally vertically extending steering axis. The steering shaft 18 is affixed in a known manner to the outboard drive 12 and specifically and normally to the drive shaft housing thereof.

A steering arm or tiller 19 is affixed to the upper end of the steering shaft 18 and extends forwardly and across the transom of the watercraft. The forward end of the steering arm 19 generally passes over the upper end of the tilt pivot pin 15. The foregoing construction may be considered to be conventional in the type of marine outboard drives which are adapted to be steered by the steering mechanism 11, which will now be described in detail.

The steering mechanism 11 includes a remote operator's portion, indicated generally by the reference numeral 21, which is comprised of a steering wheel 22 and mounting bracket 23 which journals the steering wheel 22 for rotary motion about a steering axis. The mounting bracket 23 is adapted to be mounted at any desired location in the watercraft, generally forwardly of the operator's seat. The steering wheel 22 has affixed for rotation with it a pinion gear 24 that is enmeshed with a rack 25 that is slidably supported in the mounting bracket 23 in a well known manner.

A steering operator, indicated generally by the reference numeral 26, is mounted in a manner to be described either on the transom of the watercraft directly or upon the clamping bracket 13. A bowden wire actuator 27 interconnects that rack 25 with the steering operator 26 in a manner which will be now described by particular reference to FIGS. 2-5.

The steering operator 26 is comprised of a housing assembly 28 which may be formed from a suitable lightweight material such as aluminum alloy or the like. Since the steering operator 26 is mounted internally of the watercraft on the forward side of the transom, it need not necessarily be formed from corrosion resistant materials as was true with the prior art type of constructions.

The housing assembly 28 defines a first bore 29 that forms a tubular guide member in which a steering rod 31 is supported for reciprocation. A grease fitting 32 is mounted in the housing 28 and intersects the bore 29 for lubrication of the steering rod 31. The steering rod 31 is affixed to one end of a wire actuator 33 of the bowden wire assembly 27. The other end of the wire actuator 33 is, as has been previously noted, affixed to the rack 25. A protective sheath 34 encircles the wire actuator 33 as is well known in this art.

The end of the steering rod 31 spaced from the wire actuator 33 is connected to a steering arm 35 by means of a threaded fastener 36. Upon rotation of the steering wheel 22, the rack 25 will reciprocate as will the wire actuator 33, steering rod 31 and steering arm 35 from a neutral position shown in one phantom line view in FIG. 2 to either of two extreme steering positions, one of which is also shown in phantom lines in FIG. 2. A steering link 37 is pivotally connected to the steering arm 35 at one end by a pivot pin 38. The other end of the steering link 37 is connected to the tiller 19 by a further pivot pin 39. The pivot pins 38 and 39 embody spherical connectors so as to accommodate the tilt and trim movement of the outboard motor 12 relative to the fixed steering operator 26.

A hydraulic power assist is also provided for the steering operator 26 and this hydraulic assist includes a control valve, indicated generally by the reference numeral 41, and a reciprocating type of fluid motor, indicated generally by the reference numeral 42. The fluid motor 42 is comprised of a cylinder bore 43 formed integrally within the housing 28 in parallel relationship to the bore 29 that receives the steering rod 31. The bores 29 and 43 are also parallel to, but offset from, the pivot axis defined by the tilt pin 15.

A piston 44 is slidably supported in the cylinder bore 43 and is depicted in solid lines at the extreme steering position to one side. The piston 44 divides the bore 43 into two opposite pressure chambers, which are selectively pressurized or dumped to a return under the control of the valve 41 in a manner which will be described. There is provided a remotely positioned hydraulic pump driven by an electrical motor or the like for supplying fluid pressure to the control valve 41 and fluid motor 42.

The bore 43 is open through one end of the housing 28 and is blind at its opposite end. A piston rod 45 is affixed to the piston 44 and extends through the open end where it is sealed and slidably supported by a closure plug 46 that is fixed to this open end. A gland type seal 47 and 0 ring seal 48 effect hydraulic sealing of the bore 44 while permitting reciprocal motion of the piston 44 and piston rod 45. The piston rod 45 has its outer end threaded and is received in a tapped opening 49 formed in the steering arm 35. A lock nut 51 holds the steering rod 51 to the steering arm 35. Thus, hydraulic pressure exerted on the piston 44 will assist in the steering movement of the outboard motor 12.

The control valve 41 includes a valve housing 52 that is affixed to the housing assembly 28 by means of a plurality of threaded fasteners 53. The housing 52 defines an internal bore 54 in which a valve spool 55 is supported for reciprocation. The valve housing 52 is formed with suitable supply and return passages that receive hydraulic fluid from the aforenoted pump and selectively deliver it to one of the two chambers formed on the opposite sides of the piston 44 and communicate the other side to the return, as is well known in this art. The valve spool 55 is connected by means of a bracket 56 and fastener assembly 57 to a retainer for the end of the protective sheath 34 adjacent the housing 28.

When the operator turns the steering wheel 22 one direction or the other, a force will be exerted on the wire actuator 33 so as to move the steering arm 35 in the appropriate direction. This force will create a reaction on the protective sheath 34 which is transmitted into movement of the valve spool 55 by the bracket 56 and aforedescribed connection. This will then communicate the respective side of the piston 44 with hydraulic pressure and dump the other side so as to provide a power assist. As the power assist takes place, the reaction on the protective sheath 34 will be reduced and the system will operate as a conventional and well known follow-up system.

A mounting plate 58 is affixed to the housing assembly 28 by means of a plurality of threaded fasteners 59. The mounting plate 58 is also affixed to the clamping bracket 13 by threaded fasteners 61 so that the entire unit can be mounted in a fixed position relative to the transom but nevertheless set forwardly of the transom. As a result, the entire operating device 26 and steering mechanism 11 can be assembled independently of the outboard motor 12 and pre-adjusted. The unit then is simply mounted to the clamping bracket in the manner described and thus construction is greatly simplified and the tilt pin 15 need not be designed so as to accommodate the steering rod 31. Of course, the foregoing description is that of a preferred embodiment of the invention and various changes and modifications may be made without departing from the spirit and scope of the invention, as defined by the appended claims.

We claim:

1. A steering arrangement for a marine outboard drive comprised of a clamping bracket adapted to be affixed to the transom of a watercraft, a swivel bracket, tilt pivot means for pivotally supporting said swivel bracket about a generally horizontally extending tilt axis relative to said clamping bracket, a propulsion device carried by said swivel bracket for steering movement about a vertically extending steering axis, a steering arm affixed to said propulsion device and extending toward the watercraft transom, a steering operator remote from the transom for operator control, a control cable affixed at one end to said steering operator for operation thereby, a guide tube for receiving a member operably connected to the other end of said steering cable and supporting said member for movement along a reciprocal axis parallel to and spaced from said tilt axis, a hydraulic cylinder for containing a piston operatively connected to said propulsion device for assisting in the steering, and means for operating said steering arm from said member for steering of said propulsion device.

2. A steering arrangement as set forth in claim 1 wherein the guide tube is affixed relative to the transom of the watercraft independently of the means providing the tilt axis.

3. A steering arrangement as set forth in claim 2 wherein the guide tube is affixed to the clamping bracket.

4. A steering arrangement as set forth in claim 1 wherein the axis of the hydraulic cylinder is parallel to the axis of the reciprocal axis of the member and parallel to and offset from the tilt axis.

5. A steering arrangement as set forth in claim 4 wherein the hydraulic cylinder is formed as a unit with the guide tube.

6. A steering arrangement as set forth in claim 1 further including valve means affixed to said guide tube and- said hydraulic cylinder for controlling the operation of said hydraulic cylinder.

7. A steering arrangement as set forth in claim 6 wherein the valve means is substantially coaxial with the hydraulic cylinder.

8. A steering arrangement as set forth in claim 7 wherein the axis of the hydraulic cylinder is parallel to the axis of the reciprocal axis of the member and parallel to and offset from the tilt axis.

9. A steering arrangement as set forth in claim 8 wherein the hydraulic cylinder, valve means and guide tube are all mounted as a unit.

10. A steering arrangement for a marine outboard drive comprised of a clamping bracket adapted to be affixed to the transom of a watercraft, a swivel bracket, tilt pivot means for pivotally supporting said swivel bracket about a generally horizontally extending tilt axis relative said clamping bracket, a propulsion device carried by said swivel bracket for steering about a generally vertically extending steering axis, a steering arm affixed to said propulsion device and extending toward the watercraft transom, a steering operator remote from the transom for operator control, a hydraulic cylinder having an axis that is parallel to and offset from the tilt pin axis and which is affixed to the transom independently of the tilt pin for containing a piston operated by the steering operator, and means for interconnecting said piston with said steering arm for steering of said propulsion device.

11. A steering arrangement as set forth in claim 10 wherein the hydraulic cylinder is affixed relative to the transom of the watercraft independently of the means providing the tilt axis.

12. A steering arrangement as set forth in claim 11 wherein the hydraulic cylinder is affixed to the clamping bracket.

13. A steering arrangement as set forth in claim 12 further including valve means affixed to said hydraulic cylinder for controlling the operation of said hydraulic cylinder.

14. A steering arrangement as set forth in claim 13 wherein the valve means is substantially coaxial with the hydraulic cylinder.

* * * * *